US006475251B1

(12) United States Patent
Ahmadi

(10) Patent No.: US 6,475,251 B1
(45) Date of Patent: Nov. 5, 2002

(54) METHOD FOR CONTROLLING ENGINE DEPOSITS IN A DIRECT INJECTION SPARK IGNITION GASOLINE ENGINE

(75) Inventor: Majid R. Ahmadi, Pinole, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 09/796,876

(22) Filed: Feb. 28, 2001

(51) Int. Cl.[7] ..... C10L 1/18; C10L 1/22

(52) U.S. Cl. ..... 44/387; 44/399; 44/400; 44/433

(58) Field of Search ..... 44/387, 399, 400, 44/433

(56) References Cited

U.S. PATENT DOCUMENTS

| | | | |
|---|---|---|---|
| 4,671,230 A | 6/1987 | Turnipseed | |
| 4,784,170 A | 11/1988 | Romanelli et al. | |
| 4,800,848 A | 1/1989 | Hubbard | |
| 4,807,578 A | 2/1989 | Adams et al. | |
| 4,989,561 A | 2/1991 | Hein et al. | |
| 4,992,187 A | 2/1991 | Adams et al. | |
| 5,097,806 A | 3/1992 | Vataru et al. | |
| 5,257,604 A | 11/1993 | Vataru et al. | |
| 5,503,683 A | 4/1996 | Butcher et al. | |
| 5,749,929 A | 5/1998 | Cherpeck et al. | 44/387 |
| 5,858,942 A | 1/1999 | Adams et al. | |
| 6,073,638 A | 6/2000 | Sasaki et al. | |
| 6,192,901 B1 | 2/2001 | Rome et al. | |

FOREIGN PATENT DOCUMENTS

| | | | |
|---|---|---|---|
| WO | WO 90/10051 | 9/1990 | |
| WO | WO 92/07176 | 4/1992 | |
| WO | WO 00/20537 | 4/2000 | C10L/1/22 |
| WO | WO 00/33981 | 6/2000 | |

OTHER PUBLICATIONS

Allen A. Aradi, William J. Colucci, Herbert M. Scull Jr., Martin J. Openshaw A Study of Fuel Additives for Direct Injection Gasoline (DIG) Injector Deposit Control SAE International; 2000–01–2020; pp. 283–304 (2000); SAE Publishing Group.

David C. Arters and Malcolm J. Macduff The Effect on Vehicle Performance of Injector Deposits in a Direct Injection Gasoline Engine SAE International; 2000–01–2021; pp. 295–304 (2000); SAE Publishing Group.

David C. Arters, Mitchell M. Jackson and Elizabeth A. Schiferl Using Intake Valve Deposit Cleanup Testing as a Combustion Chamber Deposit Discriminator SAE International; 982714; (Oct., 1998); pp. 1–15; SAE Publishing Group.

David C. Arters, Ewa A. Bardasz and Elizabeth A. Schiferl A Comparison of Gasoline Direct Injection and Port Fuel Injections Vehicles; Part 1—Fuel System Deposits and Vehicle Performance SAE International; 1999–01–1498; (May, 1999); pp. 1–17; SAE Publishing Group.

S. Matsushita, "Development of Direct Injection S.I. Engine (D–4)", Proceedings of JSAE (Japanese Society of Automotive Engineers), No. 9733440, Mar. 1997.

*Primary Examiner*—Cephia D. Toomer
(74) *Attorney, Agent, or Firm*—Claude J. Caroli; Joseph P. Foley

(57) ABSTRACT

A method for controlling engine deposits in a direct injection spark ignition gasoline engine which comprises operating the engine with a fuel composition comprising a major amount of hydrocarbons boiling in the gasoline range and an effective deposit-controlling amount of a fuel additive composition comprising:

(a) an aromatic ester compound of the formula:

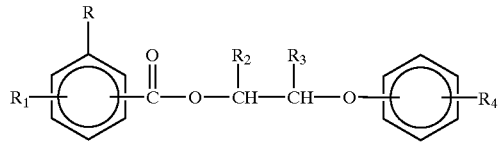

or a fuel soluble salt thereof, wherein R is hydroxy, nitro or $—(CH_2)_x—NR_5R_6$, wherein $R_5$ and $R_6$ are independently hydrogen or lower alkyl having 1 to 6 carbon atoms and x is 0 or 1; $R_1$ is hydrogen, hydroxy, nitro or $—NR_7R_8$, wherein $R_7$ and $R_8$ are independently hydrogen or lower alkyl having 1 to 6 carbon atoms; $R_2$ and $R_3$ are independently hydrogen or lower alkyl having 1 to 6 carbon atoms; and $R_4$ is a polyalkyl group having an average molecular weight in the range of about 450 to 5,000; and (b) a poly(oxyalkylene) amine having at least one basic nitrogen atom and a sufficient number of oxyalkylene units to render the poly(oxyalkylene) amine soluble in hydrocarbons boiling in the gasoline range.

99 Claims, No Drawings

METHOD FOR CONTROLLING ENGINE DEPOSITS IN A DIRECT INJECTION SPARK IGNITION GASOLINE ENGINE

BACKGROUND OF THE INVENTION

1. Field of the Invention

This invention relates to the use of fuel additive compositions containing aromatic esters of polyalkylphenoxyalkanols and poly(oxyalkylene) amines in direct injection spark ignition gasoline engines to prevent and control engine deposits.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants.

Recently, direct injection spark ignition (DISI) engines have been introduced as an alternative to conventional port fuel injection spark ignition (PFI SI) engines. In the past few years, at least three types of DISI engines (from Mitsubishi, Toyota, and Nissan) have been commercially introduced into the Japanese market, and some models are now available in Europe and selected markets in Asia. Interest in these engines stems from benefits in the area of fuel efficiency and exhaust emissions. The direct injection strategy for spark ignition engines has allowed manufacturers to significantly decrease engine fuel consumption, while at the same time maintaining engine performance characteristics and levels of gaseous emissions. The fuel/air mixture in such engines is often lean and stratified (as opposed to stoichiometric and homogeneous in conventional PFI SI engines), thus resulting in improved fuel economy.

Although there are many differences between the two engine technologies, the fundamental difference remains fuel induction strategy. In a traditional PFI SI engine, fuel is injected inside the intake ports, coming in direct contact with the intake valves, while in DISI engines fuel is directly introduced inside the combustion chamber. Recent studies have shown that DISI engines are prone to deposit build-up and in some cases, these deposits are hard to remove using conventional deposit control fuel additives. Given that the DISI engine technology is relatively new, there is concern that with accumulated use, performance and fuel economy benefits may diminish as deposits form on various surfaces of these engines. Therefore, the development of effective fuel detergents or "deposit control" additives to prevent or reduce such deposits in DISI engines is of considerable importance.

The use of polyether amines, also known as poly(oxyalkylene)amines, to control fuel injector deposits in direct injection spark ignition gasoline engines has been described in S. Matsushita, "Development of Direct Injection S.I. Engine (D-4)", Proceedings of JSAE (Japanese Society of Automotive Engineers), No. 9733440, March, 1997.

PCT International Application Publication No. WO 00/20537, published Apr. 13, 2000, discloses a gasoline additive for use in a direct injection gasoline engine which comprises at least one nitrogenous compound selected among polyoxyalkyleneamine compounds and polybutenylamine compounds.

U.S. Pat. No. 5,749,929, issued May 12, 1998 to Cherpeck et al., discloses a fuel additive composition comprising an aromatic ester of a polyalkylphenoxyalkanol and a poly(oxyalkylene) amine which is useful in fuel compositions for the control of engine deposits. However, this patent does not disclose the specific use of such additive compositions in direct injection spark ignition gasoline engines.

SUMMARY OF THE INVENTION

It has now been discovered that the combination of certain aromatic esters of polyalkylphenoxyalkanols with poly(oxyalkylene) amines affords a fuel additive composition which provides excellent control of engine deposits in direct injection spark ignition gasoline engines.

Accordingly, the present invention provides a method for controlling engine deposits in a direct injection spark ignition gasoline engine which comprises operating the engine with a fuel composition comprising a major amount of hydrocarbons boiling in the gasoline range and an effective deposit-controlling amount of a fuel additive composition comprising:

(a) an aromatic ester compound having the following formula or a fuel soluble salt thereof:

(I)

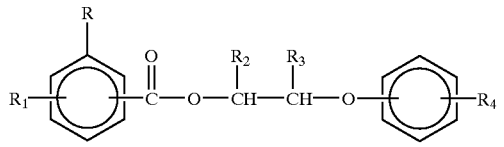

wherein R is hydroxy, nitro or —$(CH_2)_x$—$NR_5R_6$, wherein $R_5$ and $R_6$ are independently hydrogen or lower alkyl having 1 to 6 carbon atoms and x is 0 or 1;

$R_1$ is hydrogen, hydroxy, nitro or —$NR_7R_8$, wherein $R_7$ and $R_6$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) a poly(oxyalkylene) amine having at least one basic nitrogen atom and a sufficient number of oxyalkylene units to render the poly(oxyalkylene) amine soluble in hydrocarbons boiling in the gasoline range.

The present invention further provides a method for controlling engine deposits in a direct injection spark ignition gasoline engine which comprises contacting the engine intake system with a fuel additive concentrate comprising an inert stable oleophilic organic solvent boiling in the range of from about 150° F. to about 700° F. and from about 5 to about 90 weight percent of the presently employed fuel additive composition described above.

In another aspect, the present invention relates to the use of the presently employed fuel composition described above for reducing engine deposits in a direct injection spark ignition gasoline engine. In a further aspect, the present invention also relates to the use of the presently employed fuel additive concentrate described above for reducing engine deposits in a direct injection spark ignition gasoline engine.

Among other factors, the present invention is based on the surprising discovery that the combination of certain aromatic esters of polyalkylphenoxyalkanols with poly (oxyalkylene) amines provides excellent control of engine deposits, especially in injectors and combustion chambers, particularly in the piston bowl or cavity, when employed in direct injection spark ignition gasoline engines.

As used herein, the term "deposit control", or variations thereof, is meant to include the prevention, reduction or elimination of engine deposits.

DETAILED DESCRIPTION OF THE INVENTION

The Aromatic Ester of Polyalkylphenoxyalkanols

The aromatic ester component of the presently employed additive composition is an aromatic ester of a polyalkylphenoxyalkanol and has the following general formula:

(I)

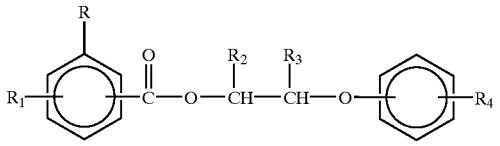

or a fuel-soluble salt thereof, wherein R, $R_1$, $R_2$, $R_3$ and $R_4$ are as defined hereinabove.

Based on performance (e.g. deposit control), handling properties and performance/cost effectiveness, the preferred aromatic ester compounds employed in the present invention are those wherein R is nitro, amino, N-alkylamino, or —$CH_2NH_2$ (aminomethyl). More preferably, R is a nitro, amino or —$CH_2NH_2$ group. Most preferably, R is an amino or —$CH_2NH_2$ group, especially amino. Preferably, $R_1$ is hydrogen, hydroxy, nitro or amino. More preferably, $R_1$ is hydrogen or hydroxy. Most preferably, $R_1$ is hydrogen. Preferably, $R_4$ is a polyalkyl group having an average molecular weight in the range of about 500 to 3,000, more preferably about 700 to 3,000, and most preferably about 900 to 2,500. Preferably, the compound has a combination of preferred substituents.

Preferably, one of $R_2$ and $R_3$ is hydrogen or lower alkyl of 1 to 4 carbon atoms, and the other is hydrogen. More preferably, one of $R_2$ and $R_3$ is hydrogen, methyl or ethyl, and the other is hydrogen. Most preferably, $R_2$ is hydrogen, methyl or ethyl, and $R_3$ is hydrogen.

When R and/or $R_1$ is an N-alkylamino group, the alkyl group of the N-alkylamino moiety preferably contains 1 to 4 carbon atoms. More preferably, the N-alkylamino is N-methylamino or N-ethylamino.

Similarly, when R and/or $R_1$ is an N,N-dialkylamino group, each alkyl group of the N,N-dialkylamino moiety preferably contains 1 to 4 carbon atoms. More preferably, each alkyl group is either methyl or ethyl. For example, particularly preferred N,N-dialkylamino groups are N,N-dimethylamino, N-ethyl-N-methylamino and N,N-diethylamino groups.

A further preferred group of compounds are those wherein R is amino, nitro, or —$CH_2NH_2$ and $R_1$ is hydrogen or hydroxy. A particularly preferred group of compounds are those wherein R is amino, $R_1$, $R_2$ and $R_3$ are hydrogen, and $R_4$ is a polyalkyl group derived from polyisobutene.

It is preferred that the R substituent is located at the meta or, more preferably, the para position of the benzoic acid moiety, i.e., para or meta relative to the carbonyloxy group. When $R_1$ is a substituent other than hydrogen, it is particularly preferred that this $R_1$ group be in a meta or para position relative to the carbonyloxy group and in an ortho position relative to the R substituent. Further, in general, when $R_1$ is other than hydrogen, it is preferred that one of R or $R_1$ is located para to the carbonyloxy group and the other is located meta to the carbonyloxy group. Similarly, it is preferred that the $R_4$ substituent on the other phenyl ring is located para or meta, more preferably para, relative to the ether linking group.

The compounds employed in the present invention will generally have a sufficient molecular weight so as to be non-volatile at normal engine intake valve operating temperatures (about 200°–250° C.). Typically, the molecular weight of the compounds employed in this invention will range from about 700 to about 3,500, preferably from about 700 to about 2,500.

Fuel-soluble salts of the compounds of formula I can be readily prepared for those compounds containing an amino or substituted amino group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluenesulfonic acid and methanesulfonic acid.

When the R or $R_1$ substituent is a hydroxy group, suitable salts can be obtained by deprotonation of the hydroxy group with a base. Such salts include salts of alkali metals, alkaline earth metals, ammonium and substituted ammonium salts. Preferred salts of hydroxy-substituted compounds include alkali metal, alkaline earth metal and substituted ammonium salts.

Definitions

As used herein, the following terms have the following meanings unless expressly stated to the contrary.

The term "amino" refers to the group: —$NH_2$.

The term "N-alkylamino" refers to the group: —$NHR_a$ wherein $R_a$ is an alkyl group. The term "N,N-dialkylamino" refers to the group: —$NR_bR_c$, wherein $R_b$ and $R_c$ are alkyl groups.

The term "alkyl" refers to both straight- and branched-chain alkyl groups. The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "polyalkyl" refers to an alkyl group which is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The term "fuel" or "hydrocarbon fuel" refers to normally liquid hydrocarbons having boiling points in the range of gasoline fuels.

General Synthetic Procedures

The polyalkylphenoxyalkyl aromatic esters employed in this invention may be prepared by the following general methods and procedures. It should be appreciated that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

Those skilled in the art will also recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, *Protective Groups in Organic Synthesis,* Second Edition, Wiley, New York, 1991, and references cited therein.

In the present synthetic procedures, a hydroxyl group will preferably be protected, when necessary, as the benzyl or tert-butyldimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the aromatic esters employed in this invention having an amino group on the aromatic moiety will generally be prepared from the corresponding nitro derivative, accordingly, in many of the following procedures, a nitro group will serve as a protecting group for the amino moiety.

Moreover, the aromatic ester compounds employed in this invention having a —$CH_2NH_2$ group on the aromatic moiety will generally be prepared from the corresponding cyano derivative, —CN. Thus, in many of the following procedures, a cyano group will serve as a protecting group for the —$CH_2NH_2$ moiety.

Synthesis

The polyalkylphenoxyalkyl aromatic esters employed in the present invention may be prepared by a process which initially involves hydroxyalkylation of a polyalkylphenol of the formula:

(II)

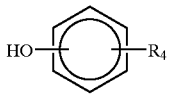

wherein $R_4$ is as defined herein, with an alkylene carbonate of the formula:

(III)

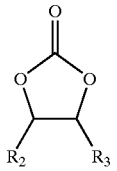

wherein $R_2$ and $R_3$ are as defined herein, in the presence of a catalytic amount of an alkali metal hydride or hydroxide, or alkali metal salt, to provide a polyalkylphenoxyalkanol of the formula:

(IV)

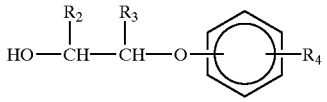

wherein $R_2$, $R_3$ and $R_4$ are as defined herein.

The polyalkylphenols of formula II are well known materials and are typically prepared by the alkylation of phenol with the desired polyolefin or chlorinated polyolefin. A further discussion of polyalkylphenols can be found, for example, in U.S. Pat. Nos. 4,744,921 and 5,300,701.

Accordingly, the polyalkylphenols of formula II may be prepared from the corresponding olefins by conventional procedures. For example, the polyalkylphenols of formula II above may be prepared by reacting the appropriate olefin or olefin mixture with phenol in the presence of an alkylating catalyst at a temperature of from about 25° C. to 150° C., and preferably 30° C. to 100° C. either neat or in an essentially inert solvent at atmospheric pressure. A preferred alkylating catalyst is boron trifluoride. Molar ratios of reactants may be used. Alternatively, molar excesses of phenol can be employed, i.e., 2 to 3 equivalents of phenol for each equivalent of olefin with unreacted phenol recycled. The latter process maximizes monoalkylphenol. Examples of inert solvents include heptane, benzene, toluene, chlorobenzene and 250 thinner which is a mixture of aromatics, paraffins and naphthenes.

The polyalkyl substituent on the polyalkylphenols employed in the invention is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkylphenols are polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Such polyisobutenes, known as "reactive" polyisobutenes, yield high molecular weight alcohols in which the hydroxyl group is at or near the end of the hydrocarbon chain. Examples of suitable polyisobutenes having a high alkylvinylidene content include Ultravis 30, a polyisobutene having a number average molecular weight of about 1300 and a methylvinylidene content of about 74%, and Ultravis 10, a polyisobutene having a number average molecular weight of about 950 and a methylvinylidene content of about 76%, both available from British Petroleum.

The alkylene carbonates of formula III are known compounds which are available commercially or can be readily prepared using conventional procedures. Suitable alkylene carbonates include ethylene carbonate, propylene carbonate, 1,2-butylene carbonate, 2,3-butylene carbonate, and the like. A preferred alkylene carbonate is ethylene carbonate.

The catalyst employed in the reaction of the polyalkylphenol and alkylene carbonate may be any of the well known hydroxyalkylation catalysts. Typical hydroxyalkylation catalysts include alkali metal hydrides, such as lithium hydride, sodium hydride and potassium hydride, alkali metal hydroxides, such as sodium hydroxide and potassium hydroxide, and alkali metal salts, for example, alkali metal halides, such as sodium chloride and potassium chloride, and alkali metal carbonates, such as sodium carbonate and potassium carbonate. The amount of catalyst employed will generally range from about 0.01 to 1.0 equivalent, preferably from about 0.05 to 0.3 equivalent.

The polyalkylphenol and alkylene carbonate are generally reacted in essentially equivalent amounts in the presence of the hydroxyalkylation catalyst at a temperature in the range of about 100° C. to 210° C., and preferably from about 150° C. to about 170° C. The reaction may take place in the presence or absence of an inert solvent.

The time of reaction will vary depending on the particular alkylphenol and alkylene carbonate reactants, the catalyst used and the reaction temperature. Generally, the reaction time will range from about two hours to about five hours. The progress of the reaction is typically monitored by the evolution of carbon dioxide. At the completion of the reaction, the polyalkylphenoxyalkanol product is isolated using conventional techniques.

The hydroxyalkylation reaction of phenols with alkylene carbonates is well known in the art and is described, for example, in U.S. Pat. Nos. 2,987,555; 2,967,892; 3,283,030 and 4,341,905.

Alternatively, the polyalkylphenoxyalkanol product of formula IV may be prepared by reacting the polyalkylphenol of formula II with an alkylene oxide of the formula:

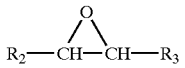

(V)

wherein $R_2$ and $R_3$ are as defined herein, in the presence of a hydroxyalkylation catalyst as described above. Suitable alkylene oxides of formula V include ethylene oxide, propylene oxide, 1,2-butylene oxide, 2,3-butylene oxide, and the like. A preferred alkylene oxide is ethylene oxide.

In a manner similar to the reaction with alkylene carbonate, the polyalkylphenol and alkylene oxide are reacted in essentially equivalent or equimolar amounts in the presence of 0.01 to 1.0 equivalent of a hydroxyalkylation catalyst, such as sodium or potassium hydride, at a temperature in the range of about 30° C. to about 150° C., for about 2 to about 24 hours. The reaction may be conducted in the presence or absence of a substantially anhydrous inert solvent. Suitable solvents include toluene, xylene, and the like. Generally, the reaction conducted at a pressure sufficient to contain the reactants and any solvent present, typically at atmospheric or higher pressure. Upon completion of the reaction, the polyalkylphenoxyalkanol is isolated by conventional procedures.

The polyalkylphenoxyalkanol of formula IV is subsequently reacted with a substituted benzoic acid of formula VI to provide the aromatic ester compounds of formula I. This reaction can be represented as follows:

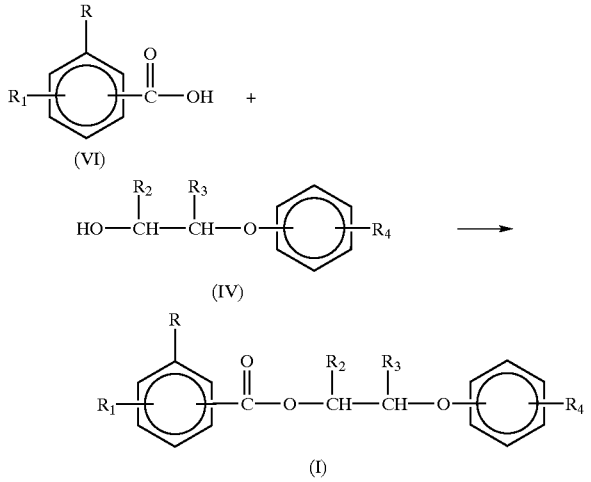

wherein R, $R_1$, $R_2$, $R_3$ and $R_4$ are as defined herein, and wherein any hydroxy or amino substituent on the substituted benzoic acid of formula VI is preferably protected with a suitable protecting group, for example, a benzyl or nitro group, respectively. Moreover, a $—CH_2NH_2$ substituent on the aromatic ring will preferably be protected by the use of a cyano group, CN.

This reaction is typically conducted by contacting a polyalkylphenoxyalkanol of formula IV with about 0.25 to about 1.5 molar equivalents of the corresponding substituted and protected benzoic acid of formula VI in the presence of an acidic catalyst at a temperature in the range of about 70° C. to about 160° C. for about 0.5 to about 48 hours. Suitable acid catalysts for this reaction include p-toluene sulfonic acid, methanesulfonic acid and the like. Optionally, the reaction can be conducted in the presence of an inert solvent, such as benzene, toluene and the like. The water generated by this reaction is preferably removed during the course of the reaction, for example, by azeotropic distillation.

The substituted benzoic acids of formula VI are generally known compounds and can be prepared from known compounds using conventional procedures or obvious modifications thereof. Representative acids suitable for use as starting materials include, for example, 2-aminobenzoic acid (anthranilic acid), 3-aminobenzoic acid, 4-aminobenzoic acid, 3-amino-4-hydroxybenzoic acid, 4-amino-3-hydroxybenzoic acid, 2-nitrobenzoic acid, 3-nitrobenzoic acid, 4-nitrobenzoic acid, 3-hydroxy-4-nitrobenzoic acid, 4-hydroxy-3-nitrobenzoic acid. When the R substituent is $—CH_2—NR_5R_6$, suitable starting materials include 4-cyanobenzoic acid and 3-cyanobenzoic acid.

Preferred substituted benzoic acids include 3-nitrobenzoic acid, 4-nitrobenzoic acid, 3-hydroxy-4-nitrobenzoic acid, 4-hydroxy-3-nitrobenzoic acid, 3-cyanobenzoic acid and 4-cyanobenzoic acid.

The compounds of formula I or their suitably protected analogs also can be prepared by reacting the polyalkylphenoxyalkanol of formula IV with an acid halide of the substituted benzoic acid of formula VI such as an acid chloride or acid bromide. This can be represented by the following reaction equation:

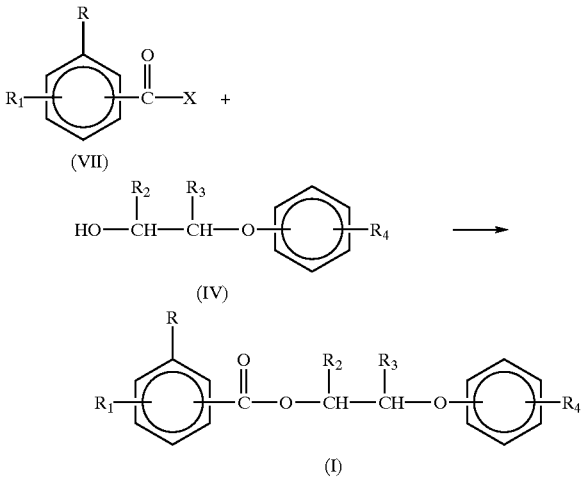

wherein X is halide, typically chloride or bromide, and R, $R_1$, $R_2$, $R_3$ and $R_4$ are as defined herein above, and wherein any hydroxy or amino substituents on the acid halide of formula VII are preferably protected with a suitable protection group, for example, benzyl or nitro, respectively. Also, when R is $—CH_2NR_5R_6$, a suitable starting material is a cyanobenzoyl halide.

Typically, this reaction is conducted by contacting the polyalkylphenoxyalkanol of formula IV with about 0.9 to about 1.5 molar equivalents of the acid halide of formula VII in an inert solvent, such as, for example, toluene, dichloromethane, diethyl ether, and the like, at a temperature in the range of about 25° C. to about 150° C. The reaction is generally complete in about 0.5 to about 48 hours. Preferably, the reaction is conducted in the presence of a sufficient amount of an amine capable of neutralizing the acid generated during the reaction, such as, for example, triethylamine, di(isopropyl)ethylamine, pyridine or 4-dimethylaminopyridine.

When the benzoic acids of formula VI or acid halides of formula VII contain a hydroxyl group, protection of the aromatic hydroxyl groups may be accomplished using well-known procedures. The choice of a suitable protecting group for a particular hydroxybenzoic carboxylic acid will be apparent to those skilled in the art. Various protecting groups, and their introduction and removal, are described, for example, in T. W. Greene and P. G. M. Wuts, *Protective Groups in Organic Synthesis,* Second Edition, Wiley, New York, 1991, and references cited therein.

After completion of the esterification, deprotection of the aromatic hydroxyl group can also be accomplished using conventional procedures. Appropriate conditions for this deprotection step will depend upon the protecting group(s) utilized in the synthesis and will be readily apparent to those skilled in the art. For example, benzyl protecting groups may be removed by hydrogenolysis under 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from about 0° C. to about 40° C. for about 1 to about 24 hours.

When the benzoic acids of formula VI or acyl halides of formula VII have a free amino group ($—NH_2$) on the phenyl moiety, it is generally desirable to first prepare the corresponding nitro compound (i.e., where R and/or $R_1$ is a nitro group) using the above-described synthetic procedures, including preparation of the acyl halides, and then reduce the nitro group to an amino group using conventional procedures. Aromatic nitro groups may be reduced to amino groups using a number of procedures that are well known in the art. For example, aromatic nitro groups may be reduced under catalytic hydrogenation conditions; or by using a reducing metal, such as zinc, tin, iron and the like, in the presence of an acid, such as dilute hydrochloric acid. Generally, reduction of the nitro group by catalytic hydrogenation is preferred. Typically, this reaction is conducted using about 1 to 4 atmospheres of hydrogen and a platinum or palladium catalyst, such as palladium on carbon. The reaction is typically carried out at a temperature of about 0° C. to about 100° C. for about 1 to 24 hours in an inert solvent, such as ethanol, ethyl acetate and the like. Hydrogenation of aromatic nitro groups is discussed in further detail in, for example, P. N. Rylander, *Catalytic Hydrogenation in Organic Synthesis,* pp. 113–137, Academic Press (1979); and *Organic Synthesis, Collective Vol. I,* Second Edition, pp. 240–241, John Wiley & Sons, Inc. (1941); and references cited therein.

Likewise, when the benzoic acids of formula VI or acyl halides of formula VII contain a $—CH_2NH_2$ group on the phenyl moiety, it is generally desirable to first prepare the corresponding cyano compounds (i.e., where R and/or $R_1$ is a —CN group), and then reduce the cyano group to a $—CH_2NH_2$ group using conventional procedures. Aromatic cyano groups may be reduced to $—CH_2NH_2$ groups using procedures well known in the art. For example, aromatic cyano groups may be reduced under catalytic hydrogenation conditions similar to those described above for reduction of aromatic nitro groups to amino groups. Thus, this reaction is typically conducted using about 1 to 4 atmospheres of hydrogen and a platinum or palladium catalyst, such as palladium on carbon. Another suitable catalyst is a Lindlar catalyst, which is palladium on calcium carbonate. The hydrogenation may be carried out at temperatures of about 0° C. to about 100° C. for about 1 to 24 hours in an inert solvent such as ethanol, ethyl acetate, and the like. Hydrogenation of aromatic cyano groups is further discussed in the references cited above for reduction of aromatic nitro groups.

The acyl halides of formula VII can be prepared by contacting the corresponding benzoic acid compound of formula VI with an inorganic acid halide, such as thionyl chloride, phosphorous trichloride, phosphorous tribromide, or phosphorous pentachloride; or with oxalyl chloride. Typically, this reaction will be conducted using about 1 to 5 molar equivalents of the inorganic acid halide or oxalyl chloride, either neat or in an inert solvent, such as diethyl ether, at a temperature in the range of about 20° C. to about 80° C. for about 1 to about 48 hours. A catalyst, such as N,N-dimethylformamide, may also be used in this reaction. Again it is preferred to first protect any hydroxy or amino substituents before converting the benzoic acid to the acyl halide.

The Poly(oxyalkylene) Amine

The poly(oxyalkylene) amine component of the presently employed fuel additive composition is a poly(oxyalkylene) amine having at least one basic nitrogen atom and a sufficient number of oxyalkylene units to render the poly (oxyalkylene) amine soluble in hydrocarbons boiling in the gasoline range.

Generally, the poly(oxyalkylene) amines suitable for use in the present invention will contain at least about 5 oxyalkylene units, preferably about 5 to 100, more preferably about 8 to 100, and even more preferably about 10 to 100.

Especially preferred poly(oxyalkylene) amines will contain about 10 to 25 oxyalkylene units.

The molecular weight of the presently employed poly (oxyalkylene) amines will generally range from about 500 to about 10,000, preferably from about 500 to about 5,000.

Suitable poly(oxyalkylene) amine compounds for use in the present invention include hydrocarbyl poly(oxyalkylene) polyamines as disclosed, for example, in U.S. Pat. No. 4,247,301, issued Jan. 27, 1981 to Honnen, the disclosure of which is incorporated herein by reference. These compounds are hydrocarbyl poly(oxyalkylene) polyamines wherein the poly(oxyalkylene) moiety comprises at least one hydrocarbyl-terminated poly(oxyalkylene) chain of 2 to 5 carbon atom oxyalkylene units, and wherein the poly (oxyalkylene) chain is bonded through a terminal carbon atom to a nitrogen atom of a polyamine having from 2 to about 12 amine nitrogen atoms and from 2 to about 40 carbon atoms with a carbon-to-nitrogen ratio between about 1:1 and 10:1. The hydrocarbyl group on these hydrocarbyl poly(oxyalkylene) polyamines will contain from about 1 to 30 carbon atoms. These compounds generally have molecular weights in the range of about 500 to 10,000, preferably from about 500 to 5,000 and more preferably from about 800 to 5,000.

The above-described hydrocarbyl poly(oxyalkylene) polyamines are prepared by conventional procedures known in the art, as taught, for example, in U.S. Pat. No. 4,247,301.

Other poly(oxyalkylene) amines suitable for use in the present invention are the poly(oxyalkylene) polyamines wherein the poly(oxyalkylene) moiety is connected to the polyamine moiety through an oxyalkylene hydroxy-type linkage derived from an epihalohydrin, such as epichlorohydrin or epibromohydrin. This type of poly(oxyalkylene) amine having an epihalohydrin-derived linkage is described, for example, in U.S. Pat. No. 4,261,704, issued Apr. 14, 1981 to Langdon, the disclosure of which is incorporated herein by reference.

Useful polyamines for preparing the epihalohydrin-derived poly(oxyalkylene) polyamines include, for example, alkylene polyamines, polyalkylene polyamines, cyclic amines, such as piperazines, and amino-substituted amines. The poly(oxyalkylene) polyamines having an epihalohydrin-derived linkage between the poly (oxyalkylene) and polyamine moieties are prepared using known procedures as taught, for example, in U.S. Pat. No. 4,261,704.

Another type of poly(oxyalkylene) amine useful in the present invention is a highly branched alkyl poly (oxyalkylene) monoamine as described, for example in U.S. Pat. No. 5,094,667, issued Mar. 10, 1992 to Schilowitz et al., the disclosure of which is incorporated herein by reference. These highly branched alkyl poly(oxyalkylene) monoamines have the general formula:

$$R'—O—(C_4H_8O)pCH_2CH_2CH_2NH_2 \quad \text{(VIII)}$$

wherein R' is a highly branched alkyl group containing from 12 to 40 carbon atoms, preferably an alkyl group having 20 carbon atoms which is derived from a Guerbet condensation reaction, and p is a number up to 30, preferably 4 to 8. The preferred alkyl group is derived from a Guerbet alcohol containing 20 carbon atoms having the formula:

$$\begin{array}{l} R''—CH—CH_2OH \\ \quad\quad\;\; | \\ \quad\quad CH_2CH_2R'' \end{array} \quad \text{(IX)}$$

wherein R" is a hydrocarbyl chain.

The above highly branched alkyl poly(oxyalkylene) monoamines are prepared by using known methods as disclosed, for example, in U.S. Pat. No. 5,094,667.

Additional poly(oxyalkylene) amines suitable for use in the present invention are the poly(oxyalkylene) amines described in PCT International Application Publication No. WO 00/20537, published Apr. 13, 2000. This PCT publication teaches that the poly(oxyalkylene) amines described therein can be obtained by using an appropriate ketimine compound as a reaction initiator to polymerize an epoxy compound and then hydrolyzing the resultant poly (oxyalkylene) glycol derivative.

A preferred class of poly(oxyalkylene) amine for use in the fuel additive composition of the present invention are hydrocarbyl poly(oxyalkylene) monoamines as described, for example, in U.S. Pat. No. 5,112,364, issued May 12, 1992 to Rath et al., the disclosure of which is incorporated herein by reference. As disclosed in U.S. Pat. No. 5,112,364, such poly(oxyalkylene) monoamines may be prepared by the reductive amination of a phenol-initiated or alkylphenol-initiated poly(oxyalkylene) alcohol with ammonia or a primary amine.

In addition, the above-mentioned U.S. Pat. No. 4,247,301 to Honnen discloses hydrocarbyl poly(oxyalkylene) monoamines which are suitable for use in the present fuel additive composition. In particular, Example 6 of this patent describes alkylphenyl poly(oxyalkylene) monoamines prepared from ammonia and dimethylamine.

A particularly preferred type of hydrocarbyl poly (oxyalkylene) monoamine is an alkylphenyl poly (oxyalkylene) monoamine wherein the poly(oxyalkylene) moiety contains oxypropylene units or oxybutylene units or mixtures of oxypropylene and oxybutylene units. Preferably, the alkyl group on the alkylphenyl moiety is a straight or branched-chain alkyl of 1 to 24 carbon atoms. An especially preferred alkylphenyl moiety is tetrapropenylphenyl, that is, where the alkyl group is a branched-chain alkyl of 12 carbon atoms derived from propylene tetramer.

A further discussion of the hydrocarbon-substituted poly (oxyalkylene) moiety on the poly(oxyalkylene) amine component of the presently employed fuel additive composition is found hereinbelow.

Another preferred class of poly(oxyalkylene) amine for use in the fuel additive composition employed in the present invention are hydrocarbyl-substituted poly(oxyalkylene) aminocarbamates disclosed, for example, in U.S. Pat. Nos. 4,288,612; 4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene) aminocarbamates contain at least one basic nitrogen atom and have an average molecular weight of about 500 to 10,000, preferably about 500 to 5,000, and more preferably about 1,000 to 3,000. As described more fully hereinbelow, these hydrocarbyl poly (oxyalkylene) aminocarbamates contain (a) a poly (oxyalkylene) moiety, (b) an amine moiety and (c) a carbamate connecting group.

A. The Poly(oxyalkylene) Moiety

The hydrocarbyl-terminated poly(oxyalkylene) polymers which are utilized in preparing the hydrocarbyl poly (oxyalkylene) aminocarbamates employed in the present invention are monohydroxy compounds, e.g., alcohols, often termed monohydroxy polyethers, or polyalkylene glycol monocarbyl ethers, or "capped" poly(oxyalkylene) glycols, and are to be distinguished from the poly(oxyalkylene) glycols (diols), or polyols, which are not hydrocarbyl-terminated, i.e., are not capped. These hydrocarbyl poly (oxyalkylene) alcohols may be produced by the addition of lower alkylene oxides, such as ethylene oxide, propylene oxide, butylene oxide, etc. to a hydroxy compound, $R_9OH$, under polymerization conditions, wherein $R_9$ is the hydrocarbyl group which caps the poly(oxyalkylene) chain.

In the hydrocarbyl poly(oxyalkylene) aminocarbamates employed in the present invention, the hydrocarbyl group $R_9$ will generally contain from 1 to about 30 carbon atoms, preferably from 2 to about 20 carbon atoms and is preferably aliphatic or aromatic, i.e., an alkyl or alkyl phenyl wherein the alkyl is a straight or branched-chain of from 1 to about 24 carbon atoms. More preferably, $R_9$ is alkylphenyl wherein the alkyl group is a branched-chain of 12 carbon atoms, derived from propylene tetramer, and commonly referred to as tetrapropenyl.

The oxyalkylene units in the poly(oxyalkylene) moiety preferably contain from 2 to about 5 carbon atoms but one or more units of a larger carbon number may also be present.

Generally, each poly(oxyalkylene) polymer contains at least about 5 oxyalkylene units, preferably about 5 to about 100 oxyalkylene units, more preferably about 8 to about 100 units, even more preferably about 10 to 100 units, and most preferably 10 to about 25 such units. The poly(oxyalkylene) moiety of the hydrocarbyl poly(oxyalkylene) aminocarbamates employed in the present invention is more fully described and exemplified in U.S. Pat. No. 4,191,537, issued Mar. 4, 1980 to Lewis, the disclosure of which is incorporated herein by reference.

Although the hydrocarbyl group on the hydrocarbyl poly (oxyalkylene) moiety will preferably contain from 1 to about 30 carbon atoms, longer hydrocarbyl groups, particularly longer chain alkyl phenyl groups, may also be employed. For example, alkylphenyl poly(oxyalkylene) aminocarbamates wherein the alkyl group contains at least 40 carbon atoms, as described in U.S. Pat. No. 4,881,945, issued Nov. 21, 1989 to Buckley, are also contemplated for use in the present invention. The alkyl phenyl group on the aminocarbamates of U.S. Pat. No. 4,881,945 will preferably contain an alkyl group of 50 to 200 carbon atoms, and more preferably, an alkyl group of 60 to 100 carbon atoms. These longer chain alkyl groups will generally be derived from olefin polymers, such as polybutene. The disclosure of U.S. Pat. No. 4,881,945 is incorporated herein by reference.

Also contemplated for use in the present invention are alkylphenyl poly(oxypropylene) aminocarbamates wherein the alkyl group is a substantially straight-chain alkyl group of about 25 to 50 carbon atoms derived from an alpha olefin oligomer of $C_8$ to $C_{20}$ alpha olefins, as described in PCT International Patent Application Publication No. WO 90/07564, published Jul. 12, 1990, the disclosure of which is incorporated herein by reference.

B. The Amine Moiety

The amine moiety of the hydrocarbyl poly(oxyalkylene) aminocarbamate is preferably derived from a polyamine having from 2 to about 12 amine nitrogen atoms and from 2 to about 40 carbon atoms.

The polyamine is preferably reacted with a hydrocarbyl poly(oxyalkylene) chloroformate to produce the hydrocarbyl poly(oxyalkylene) aminocarbamate fuel additive finding use within the scope of the present invention. The chloroformate is itself derived from the hydrocarbyl poly (oxyalkylene) alcohol by reaction with phosgene.

The polyamine provides the hydrocarbyl poly (oxyalkylene) aminocarbamate with, on the average, at least about one basic nitrogen atom per carbamate molecule, i.e., a nitrogen atom titratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The amine moiety of the hydrocarbyl poly(oxyalkylene) aminocarbamates employed in the present invention has been described and exemplified more fully in U.S. Pat. No. 4,191,537.

A more preferred polyamine for use in preparing the hydrocarbyl poly(oxyalkylene) aminocarbamates finding use within the scope of the present invention is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylenetriamine, triethylenetetramine, di(trimethylene)triamine, dipropylenetriamine, tetraethylenepentamine, etc.

Among the polyalkylene polyamines, polyethylene polyamine and polypropylene polyamine containing 2 to about 12 amine nitrogen atoms and 2 to about 24 carbon atoms are especially preferred and in particular, the lower polyalkylene polyamines, e.g., ethylenediamine, diethylenetriamine, propylenediamine, dipropylenetriamine, etc., are most preferred.

C. The Aminocarbamate Connecting Group

The hydrocarbyl poly(oxyalkylene) aminocarbamate employed as the poly(oxyalkylene) amine component of the fuel additive composition employed in the present invention is obtained by linking the polyamine and the hydrocarbyl poly(oxyalkylene) alcohol together through a carbamate linkage, i.e.,

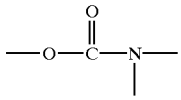

wherein the oxygen may be regarded as the terminal hydroxyl oxygen of the poly(oxyalkylene) alcohol, the nitrogen is derived from the polyamine and the carbonyl group —C(O)—, is preferably provided by a coupling agent, such as phosgene.

In a preferred method of preparation, the hydrocarbyl poly(oxyalkylene) alcohol is reacted with phosgene to produce a chloroformate and the chloroformate is reacted with the polyamine. Since there may be more than one nitrogen atom of the polyamine which is capable of reacting with the chloroformate, the carbamate product may contain more than one hydrocarbyl poly(oxyalkylene) moiety. It is preferred that the hydrocarbyl poly(oxyalkylene) aminocarbamate product contains on the average, about one poly (oxyalkylene) moiety per molecule (i.e., is a monocarbamate), although it is understood that this reaction route may lead to mixtures containing appreciable amounts of di- or higher poly(oxyalkylene) chain substitution on a polyamine containing several reactive nitrogen atoms.

A particularly preferred aminocarbamate is alkylphenyl poly(oxybutylene) aminocarbamate, wherein the amine moiety is derived from ethylene diamine or diethylene triamine. Synthetic methods to avoid higher degrees of substitution, methods of preparation, and other characteristics of the aminocarbamates used in the present invention are more filly described and exemplified in U.S. Pat. No. 4,191,537.

The most preferred poly(oxyalkylene) amine employed in the present invention is a hydrocarbyl-substituted poly (oxyalkylene) amine compound of the formula:

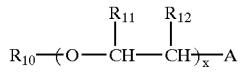

(X)

or a fuel-soluble salt thereof;

wherein $R_{10}$ is a hydrocarbyl group having from about 1 to about 30 carbon atoms;

$R_{11}$ and $R_{12}$ are each independently hydrogen or lower alkyl having from about 1 to about 6 carbon atoms and each $R_{11}$ and $R_{12}$ is independently selected in each —O—$CHR_{11}$—$CHR_{12}$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

In Formula X, above, $R_{10}$ is a hydrocarbyl group having from about 1 to about 30 carbon atoms. Preferably, $R_{10}$ is an alkyl or alkylphenyl group. More preferably, $R_{10}$ is an alkylphenyl group, wherein the alkyl moiety is a straight or branched chain alkyl of from about 1 to about 24 carbon atoms.

Preferably, one of $R_{11}$ and $R_{12}$ is lower alkyl of 1 to 4 carbon atoms, and the other is hydrogen. More preferably, one of $R_{11}$ and $R_{12}$ is methyl or ethyl, and the other is hydrogen.

In general, A is amino, N-alkyl amino having from about 1 to about 20 carbon atoms in the alkyl group, preferably about 1 to about 6 carbon atoms, more preferably about 1 to about 4 carbon atoms; N,N-dialkyl amino having from about 1 to about 20 carbon atoms in each alkyl group, preferably about 1 to about 6 carbon atoms, more preferably about 1 to about 4 carbon atoms; or a polyamine moiety having from about 2 to about 12 amine nitrogen atoms and from about 2 to about 40 carbon atoms, preferably about 2 to 12 amine nitrogen atoms and about 2 to 24 carbon atoms. More preferably, A is amino or a polyamine moiety derived from a polyalkylene polyamine, including alkylene diamine. Most preferably, A is amino or a polyamine moiety derived from ethylene diamine or diethylene triamine.

Preferably, x is an integer from about 5 to about 50, more preferably from about 8 to about 30, and most preferably from about 10 to about 25.

Fuel-soluble salts of the compounds of Formula X can be readily prepared for those compounds containing an amino or substituted amino group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluenesulfonic acid and methanesulfonic acid.

Definitions

As used herein, the following terms have the following meanings unless expressly stated to the contrary.

The term "amino" refers to the group: —$NH_2$.

The term "N-alkylamino" refers to the group: —$NHR_a$ wherein $R_a$ is an alkyl group. The term "N,N-dialkylamino" refers to the group: —$NR_bR_c$, wherein $R_b$ and $R_c$ are alkyl groups.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups are generally free of aliphatic unsaturation, i.e., olefinic or acetylenic unsaturation, but may contain minor amounts of heteroatoms, such as oxygen or nitrogen, or halogens, such as chlorine.

The term "alkyl" refers to both straight- and branched-chain alkyl groups.

The term "lower alkyl" refers to alkyl groups having 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "alkylene" refers to straight- and branched-chain alkylene groups having at least 2 carbon atoms. Typical alkylene groups include, for example, ethylene (—$CH_2CH_2$—), propylene (—$CH_2CH_2CH_2$—), isopropylene (—$CH(CH_3)CH_2$—), n-butylene (—$CH_2CH_2CH_2CH_2$—), sec-butylene (—$CH(CH_2CH_3)CH_2$—), n-pentylene (—$CH_2CH_2CH_2CH_2CH_2$—), and the like.

The term "poly(oxyalkylene)" refers to a polymer or oligomer having the general formula:

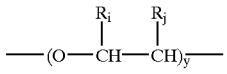

wherein $R_i$ and $R_j$ are each independently hydrogen or lower alkyl groups, and y is an integer from about 5 to about 100. When referring herein to the number of oxyalkylene units in a particular polyoxyalkylene compound, it is to be understood that this number refers to the average number of oxyalkylene units in such compounds unless expressly stated to the contrary.

General Synthetic Procedures

The preferred hydrocarbyl-substituted poly(oxyalkylene) amines employed in this invention may be prepared by the following general methods and procedures. It should be appreciated that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

The preferred hydrocarbyl-substituted poly(oxyalkylene) amines employed in the present invention contain (a) a hydrocarbyl-substituted poly(oxyalkylene) component, and (b) an amine component.

A. The Hydrocarbyl-Substituted Poly(oxyalkylene) Component

The hydrocarbyl-substituted poly(oxyalkylene) polymers which are utilized in preparing the hydrocarbyl-substituted poly(oxyalkylene) amines employed in the present invention are monohydroxy compounds, i.e., alcohols, often termed hydrocarbyl "capped" poly(oxyalkylene) glycols and are to be distinguished from the poly(oxyalkylene) glycols (diols), which are not hydrocarbyl terminated, i.e., not capped. The hydrocarbyl-substituted poly(oxyalkylene) alcohols are produced by the addition of lower alkylene oxides, such as ethylene oxide, propylene oxide, or the butylene oxides, to the hydroxy compound, $R_{10}OH$, under polymerization conditions, wherein $R_{10}$ is the hydrocarbyl group, as defined above, which caps the polyoxyalkylene chain. Preferred poly(oxyalkylene) polymers are those derived from $C_3$ to $C_4$ oxyalkylene units. Methods of production and properties of these polymers are disclosed in U.S. Pat. Nos. 2,841,479 and 2,782,240 and Kirk-Othmer's *"Encyclopedia of Chemical Technology"*, Volume 19, page 507. In the polymerization reaction, a single type of alkylene oxide may be employed, e.g., propylene oxide, in which case the product is a homopolymer, e.g., a poly(oxypropylene) alcohol. However, copolymers are equally satisfactory and random copolymers are readily prepared by contacting the hydroxy-containing compound with a mixture of alkylene oxides, such as a mixture of propylene and butylene oxides. Block copolymers of oxyalkylene units also provide satisfactory poly (oxyalkylene) units for the practice of the present invention.

The amount of alkylene oxide employed in this reaction will generally depend on the number of oxyalkylene units desired in the product. Typically, the molar ratio of alkylene oxide to hydroxy-containing compound will range from about 5:1 to about 100:1; preferably, from about 5:1 to about 50:1, more preferably from about 8:1 to about 30:1.

Alkylene oxides suitable for use in this polymerization reaction include, for example, ethylene oxide; propylene oxide; and butylene oxides, such as 1,2-butylene oxide (1,2-epoxybutane) and 2,3-butylene oxide (2,3-epoxybutane). Preferred alkylene oxides are propylene oxide and 1,2-butylene oxide, both individually and in mixtures thereof.

The hydrocarbyl moiety, $R_{10}$, which terminates the poly (oxyalkylene) chain will generally contain from about 1 to about 30 carbon atoms, preferably from about 2 to about 20 carbon atoms, and more preferably from about 4 to about 18 carbon atoms, and is generally derived from the monohydroxy compound, $R_{10}OH$, which is the initial site of the alkylene oxide addition in the polymerization reaction. Such monohydroxy compounds are preferably aliphatic or aromatic alcohols having from about 1 to about 30 carbon atoms, more preferably and alkanol or an alkylphenol, and most preferably an alkyphenol wherein the alkyl substituent is a straight or branched chain alkyl of from about 1 to about 24 carbon atoms. Preferred alkylphenols include those wherein the alkyl substituent contains from about 4 to about 16 carbon atoms. An especially preferred alkylphenol is one wherein the alkyl group is obtained by polymerizing propylene to an average of 4 propylene units, that is, about 12 carbon atoms, having the common name of propylene tetramer. The resulting alkylphenol is commonly called tetrapropenylphenol or, more generically, dodecylphenol. Preferred alkylphenol-initiated poly(oxyalkylene) compounds may be termed either alkylphenylpoly(oxyalkylene) alcohols or polyalkoxylated alkylphenols.

B. The Amine Component

As indicated above, the preferred hydrocarbyl-substituted poly(oxyalkylene) amines employed in the present invention contain an amine component.

In general, the amine component will contain an average of at least about one basic nitrogen atom per molecule. A "basic nitrogen atom" is one that is titratable by a strong acid, for example, a primary, secondary, or tertiary amine nitrogen; as distinguished from, for example, an carbamyl nitrogen, e.g., —OC(O)NH—, which is not titratable with a strong acid. Preferably, at least one of the basic nitrogen atoms of the amine component will be primary or secondary amine nitrogen, more preferably at least one will be a primary amine nitrogen.

The amine component of the preferred hydrocarbyl-substituted poly(oxyalkylene) amines employed in this invention is preferably derived from ammonia, a primary alkyl or secondary dialkyl monoamine, or a polyamine having a terminal amino nitrogen atom.

Primary alkyl monoamines useful in preparing compounds employed in the present invention contain 1 nitrogen atom and from about 1 to about 20 carbon atoms, more preferably about 1 to 6 carbon atoms, most preferably 1 to 4 carbon atoms. Examples of suitable monoamines include N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl) amine, 2-aminoethanol, 3-amino-1-propanol, 2-(2-aminoethoxy)ethanol, N-(2-methoxyethyl)amine, N-(2-ethoxyethyl)amine and the like. Preferred primary amines are N-methylamine, N-ethylamine and N-n-propylamine.

The amine component of the presently employed fuel additive may also be derived from a secondary dialkyl monoamine. The alkyl groups of the secondary amine may be the same or different and will generally each contain about 1 to about 20 carbon atoms, more preferably about 1 to about 6 carbon atoms, most preferably about 1 to about 4 carbon atoms. One or both of the alkyl groups may also contain one or more oxygen atoms.

Preferably, the alkyl groups of the secondary amine are independently selected from the group consisting of methyl, ethyl, propyl, butyl, pentyl, hexyl, 2-hydroxyethyl and 2-methoxyethyl. More preferably, the alkyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N,N-di(3-hydroxypropyl)amine, N,N-di(ethoxyethyl)amine, N,N-di (propoxyethyl)amine and the like. Preferred secondary amines are N,N-dimethylamine, N,N-diethylamine and N,N-di-n-propylamine.

Cyclic secondary amines may also be used to form the additives employed in this invention. In such cyclic compounds, the alkyl groups, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine and the like.

Suitable polyamines can have a straight- or branched-chain structure and may be cyclic or acyclic or combinations thereof. Generally, the amine nitrogen atoms of such polyamines will be separated from one another by at least two carbon atoms, i.e., polyamines having an aminal structure are not suitable. The polyamine may also contain one or more oxygen atoms, typically present as an ether or a hydroxyl group. Polyamines having a carbon-to-nitrogen ratio of from about 1:1 to about 10:1 are particularly preferred.

In preparing the compounds employed in this invention using a polyamine where the various nitrogen atoms of the polyamine are not geometrically equivalent, several substitutional isomers are possible and each of these possible isomers is encompassed within this invention.

A particularly preferred group of polyamines for use in the present invention are polyalkylene polyamines, including alkylene diamines. Such polyalkylene polyamines will typically contain from about 2 to about 12 nitrogen atoms and from about 2 to about 40 carbon atoms, preferably about 2 to 24 carbon atoms. Preferably, the alkylene groups of such polyalkylene polyamines will contain from about 2 to about 6 carbon atoms, more preferably from about 2 to about 4 carbon atoms.

Examples of suitable polyalkylene polyamines include ethylenediamine, propylenediamine, isopropylenediamine, butylenediamine, pentylenediamine, hexylenediamine, diethylenetriamine, dipropylenetriamine, dimethylaminopropylamine, diisopropylenetriamine, dibutylenetriamine, di-sec-butylenetriamine, triethylenetetraamine, tripropylenetetraamine, triisobutylenetetraamine, tetraethylenepentamine, pentaethylenehexamine, dimethylaminopropylamine, and mixtures thereof.

Particularly suitable polyalkylene polyamines are those having the formula:

$$H_2N—(R_{13}—NH)_z—H$$

wherein $R_{13}$ is a straight- or branched-chain alkylene group having from about 2 to about 6 carbon atoms, preferably from about 2 to about 4 carbon atoms, most preferably about 2 carbon atoms, i.e., ethylene ($—CH_2CH_2—$); and z is an integer from about 1 to about 4, preferably about 1 or about 2.

Particularly preferred polyalkylene polyamines are ethylenediamine, diethylenetriamine, triethylenetetraamine, and tetraethylenepentamine. Most preferred are ethylenediamine and diethylenetriamine, especially ethylenediamine.

Also contemplated for use in the present invention are cyclic polyamines having one or more 5- to 6-membered rings. Such cyclic polyamines compounds include piperazine, 2-methylpiperazine, N-(2-aminoethyl) piperazine, N-(2-hydroxyethyl)piperazine, 1,2-bis-(N-piperazinyl)ethane, 3-aminopyrrolidine, N-(2-aminoethyl) pyrrolidine, and the like. Among the cyclic polyamines, the piperazines are preferred.

Many of the polyamines suitable for use in the present invention are commercially available and others may be prepared by methods which are well known in the art. For example, methods for preparing amines and their reactions are detailed in Sidgewick's "*The Organic Chemistry of Nitrogen*", Clarendon Press, Oxford, 1966; Noller's "*Chemistry of Organic Compounds*", Saunders, Philadelphia, 2nd Ed., 1957; and Kirk-Othmer's *"Encyclopedia of Chemical Technology"*, 2nd Ed., especially Volume 2, pp. 99–116.

C. Preparation of the Hydrocarbyl-Substituted Poly (oxyalkylene) Amine

The preferred hydrocarbyl-substituted poly(oxyalkylene) amine additives employed in this invention may be conveniently prepared by reacting a hydrocarbyl-substituted poly (oxyalkylene) alcohol, either directly or through an intermediate, with a nitrogen-containing compound, such as ammonia, a primary or secondary alkyl monoamine or a polyamine, as described herein.

The hydrocarbyl-substituted poly(oxyalkylene) alcohols used to form the poly(oxyalkylene) amines employed in the present invention are typically known compounds that can be prepared using conventional procedures. Suitable procedures for preparing such compounds are taught, for example, in U.S. Pat. Nos. 2,782,240 and 2,841,479, as well as U.S. Pat. No. 4,881,945, the disclosures of which are incorporated herein by reference.

Preferably, the poly(oxyalkylene) alcohols are prepared by contacting an alkoxide or phenoxide metal salt with from about 5 to about 100 molar equivalents of an alkylene oxide, such as propylene oxide or butylene oxide, or mixtures of alkylene oxides.

Typically, the alkoxide or phenoxide metal salt is prepared by contacting the corresponding hydroxy compound with a strong base, such as sodium hydride, potassium hydride, sodium amide, and the like, in an inert solvent, such as toluene, xylene, and the like, under substantially anhydrous conditions at a temperature in the range from about −10° C. to about 120° C. for from about 0.25 to about 3 hours.

The alkoxide or phenoxide metal salt is generally not isolated, but is reacted in situ with the alkylene oxide or mixture of alkylene oxides to provide, after neutralization, the poly(oxyalkylene) alcohol. This polymerization reaction is typically conducted in a substantially anhydrous inert solvent at a temperature of from about 30° C. to about 150° C. for from about 2 to about 120 hours. Suitable solvents for this reaction, include toluene, xylene, and the like. Typically, the reaction is conducted at a pressure sufficient to contain the reactants and the solvent, preferably at atmospheric or ambient pressure.

The hydrocarbyl-substituted poly(oxyalkylene) alcohol may then be converted to the desired poly(oxyalkylene) amine by a variety of procedures known in the art.

For example, the terminal hydroxy group on the hydrocarbyl-substituted poly(oxyalkylene) alcohol may first be converted to a suitable leaving group, such as a mesylate, chloride or bromide, and the like, by reaction with a suitable reagent, such as methanesulfonyl chloride. The resulting poly(oxyalkylene) mesylate or equivalent intermediate may then be converted to a phthalimide derivative by reaction with potassium phthalimide in the presence of a suitable solvent, such as N,N-dimethylformamide. The poly (oxyalkylene) phthalimide derivative is subsequently converted to the desired hydrocarbyl-substituted poly (oxyalkylene) amine by reaction with a suitable amine, such as hydrazine.

The poly(oxyalkylene) alcohol may also be converted to the corresponding poly(oxyalkylene) chloride by reaction with a suitable halogenating agent, such as HCl, thionyl chloride, or epichlorohydrin, followed by displacement of the chloride with a suitable amine, such as ammonia, a primary or secondary alkyl monoamine, or a polyamine, as described, for example, in U.S. Pat. No. 4,247,301 to Honnen, the disclosure of which is incorporated herein by reference.

Alternatively, the preferred hydrocarbyl-substituted poly (oxyalkylene) amines employed in the present invention may be prepared from the corresponding poly(oxyalkylene) alcohol by a process commonly referred to as reductive amination, such as described in U.S. Pat. No. 5,112,364 to Rath et al. and U.S. Pat. No. 4,332,595 to Herbstman et al., the disclosures of which are incorporated herein by reference.

In the reductive amination procedure, the hydrocarbyl-substituted poly(oxyalkylene) alcohol is aminated with an appropriate amine, such as ammonia or a primary alkyl monoamine, in the presence of hydrogen and a hydrogenation-dehydrogenation catalyst. The amination reaction is typically carried out at temperatures in the range of about 160° C. to about 250° C. and pressures of about 1,000 to about 5,000 psig, preferably about 1,500 to about 3,000 psig. Suitable hydrogenation-dehydrogenation catalysts include those containing platinum, palladium, cobalt, nickel, copper, or chromium, or mixtures thereof. Generally, an excess of the ammonia or amine reactant is used, such as about a 5-fold to about 60-fold molar excess, and preferably about a 10-fold to about 40-fold molar excess, of ammonia or amine.

When the reductive amination is carried out with a polyamine reactant, the amination is preferably conducted using a two-step procedure as described in European Patent Application Publication No. EP 0,781,793, published Jul. 2, 1997, the disclosure of which is incorporated herein by reference in its entirety. According to this procedure, a poly(oxyalkylene) alcohol is first contacted with a hydrogenation-dehydrogenation catalyst at a temperature of at least 230° C. to provide a polymeric carbonyl intermediate, which is subsequently reacted with a polyamine at a temperature below about 190° C. in the presence of hydrogen and a hydrogenation catalyst to produce the poly(oxyalkylene) polyamine adduct.

Fuel Compositions

The fuel additive composition employed in the present invention will generally be employed in hydrocarbon fuels to prevent and control engine deposits in direct injection spark ignition gasoline engines. The proper concentration of additive necessary to achieve the desired deposit control varies depending upon the type of fuel employed, the type of DISI engine, and the presence of other fuel additives.

Generally, the presently employed fuel additive composition will be employed in a hydrocarbon fuel in a concentration ranging from about 50 to about 15,000 parts per million (ppm) by weight, preferably from 100 to 7,000 ppm.

In terms of individual components, hydrocarbon fuel containing the fuel additive composition employed this invention will generally contain about 25 to 5,000 ppm, preferably about 50 to 2,000 ppm, of the polyalkylphenoxyalkyl aromatic ester component and about 25 to 10,000 ppm, preferably about 50 to 5,000 ppm, of the poly(oxyalkylene) amine component. The ratio of the polyalkylphenoxyalkyl aromatic ester to poly(oxyalkylene) amine will generally range from about 0.02:1 to about 10:1, and will preferably be about 0.05:1 to about 5:1.

The fuel additive composition employed in of the present invention may be formulated as a concentrate using an inert stable oleophilic (i.e., dissolves in gasoline) organic solvent boiling in the range of about 150° F. to about 700° F. (about 65° C. to about 371° C.). Preferably, an aliphatic or an aromatic hydrocarbon solvent is used, such as benzene, toluene, xylene or higher-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the additive will generally range from about 5 to about 90 weight percent, preferably about 10 to about 70 weight percent, more preferably about 10 to 50 weight percent, and even more preferably from about 20 to 40 weight percent.

The fuel additive concentrate employed in the present invention may be added as such to the hydrocarbon fuel for use in the direct injection spark ignition gasoline engine. Alternatively, the intake system of the direct injection spark ignition gasoline engine may be contacted directly with the presently employed fuel additive concentrate, for example, in the form of an aerosol spray, or a gravitational feed.

In gasoline fuels, other fuel additives may be employed with the additive composition employed in the present invention, including, for example, oxygenates, such as t-butyl methyl ether, antiknock agents, such as methylcyclopentadienyl manganese tricarbonyl, and other dispersants/detergents, such as hydrocarbyl amines, or succinimides. Additionally, antioxidants, metal deactivators, demulsifiers and carburetor or fuel injector detergents may be present.

The gasoline fuels employed with the additive composition used in the present invention also include clean burning gasoline where levels of sulfur, aromatics and olefins range from typical amounts to only trace amounts.

A fuel-soluble, nonvolatile carrier fluid or oil may also be used with the fuel additive composition employed in the present invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic polyoxyalkylene-derived fluids, such as those described, for example, in U.S. Pat. No. 4,191,537 to Lewis, and polyesters, such as those described, for example, in U.S. Pat. No. 3,756,793 to Robinson and U.S. Pat. No. 5,004,478 to Vogel et al., and in European Patent Application Nos. 356,726, published Mar. 7, 1990, and 382,159, published Aug. 16, 1990.

These carrier fluids are believed to act as a carrier for the fuel additive composition employed in the present invention and to assist in removing and retarding deposits. The carrier fluid may also exhibit synergistic deposit control properties when used in combination with the fuel additive composition employed in this invention.

The carrier fluids are typically employed in amounts ranging from about 25 to about 15,000 ppm by weight of the hydrocarbon fuel, preferably from 100 to 7,000 ppm of the fuel. Preferably, the ratio of carrier fluid to deposit control additive will range from about 0.2:1 to about 10:1, more preferably from about 0.5:1 to about 3:1.

When employed in a fuel concentrate, carrier fluids will generally be present in amounts ranging from about 10 to about 80 weight percent, preferably from about 20 to about 60 weight percent, and more preferably from about 30 to about 50 weight percent.

PREPARATIONS AND EXAMPLES

A further understanding of the invention can be had in the following nonlimiting Examples. Wherein unless expressly stated to the contrary, all temperatures and temperature ranges refer to the Centigrade system and the term "ambient" or "room temperature" refers to about 20° C. to 25° C. The term "percent" or "%" refers to weight percent and the term "mole" or "moles" refers to gram moles. The term "equivalent" refers to a quantity of reagent equal in moles, to the moles of the preceding or succeeding reactant recited in that example in terms of finite moles or finite weight or volume. Where given, proton-magnetic resonance spectrum (p.m.r. or n.m.r.) were determined at 300 mHz, signals are assigned as singlets (s), broad singlets (bs), doublets (d), double doublets (dd), triplets (t), double triplets (dt), quartets (q), and multiplets (m), and cps refers to cycles per second.

Example 1

Preparation of Polyisobutyl Phenol

To a flask equipped with a magnetic stirrer, reflux condenser, thermometer, addition funnel and nitrogen inlet was added 203.2 grams of phenol. The phenol was warmed to 40° C. and the heat source was removed. Then, 73.5 milliliters of boron trifluoride etherate was added dropwise. 1040 grams of Ultravis 10 Polyisobutene (molecular weight 950, 76% methylvinylidene, available from British Petroleum) was dissolved in 1,863 milliliters of hexane. The polyisobutene was added to the reaction at a rate to maintain the temperature between 22° C. to 27° C. The reaction mixture was stirred for 16 hours at room temperature. Then, 400 milliliters of concentrated ammonium hydroxide was added, followed by 2,000 milliliters of hexane. The reaction mixture was washed with water (3×2,000 milliliters), dried over magnesium sulfate, filtered and the solvents removed under vacuum to yield 1,056.5 grams of a crude reaction product. The crude reaction product was determined to contain 80% of the desired product by proton NMR and chromatography on silica gel eluting with hexane, followed by hexane:ethylacetate:ethanol (93:5:2).

Example 2

Preparation of

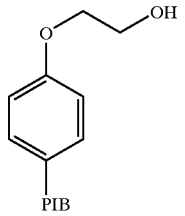

(molecular weight ~ 950)

1.1 grams of a 35 weight percent dispersion of potassium hydride in mineral oil and 4-polyisobutyl phenol (99.7 grams, prepared as in Example 1) were added to a flask equipped with a magnetic stirrer, reflux condenser, nitrogen inlet and thermometer. The reaction was heated at 130° C. for one hour and then cooled to 100° C. Ethylene carbonate (8.6 grams) was added and the mixture was heated at 160° C. for 16 hours. The reaction was cooled to room temperature and one milliliter of isopropanol was added. The reaction was diluted with one liter of hexane, washed three times with water and once with brine. The organic layer was dried over anhydrous magnesium sulfate, filtered and the solvents removed in vacuo to yield 98.0 grams of the desired product as a yellow oil.

Example 3

Preparation of

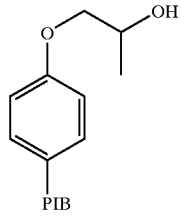

(molecular weight ~ 950)

15.1 grams of a 35 weight percent dispersion of potassium hydride in mineral oil and 4-polyisobutyl phenol (1378.5 grams, prepared as in Example 1) were added to a flask equipped with a mechanical stirrer, reflux condensor, nitrogen inlet and thermometer. The reaction was heated at 130° C. for one hour and then cooled to 100° C. Propylene carbonate (115.7 milliliters) was added and the mixture was heated at 160° C. for 16 hours. The reaction was cooled to room temperature and ten milliliters of isopropanol were added. The reaction was diluted with ten liters of hexane, washed three times with water and once with brine. The organic layer was dried over anhydrous magnesium sulfate, filtered and the solvents removed in vacuo to yield 1301.7 grams of the desired product as a yellow oil.

Example 4

Preparation of

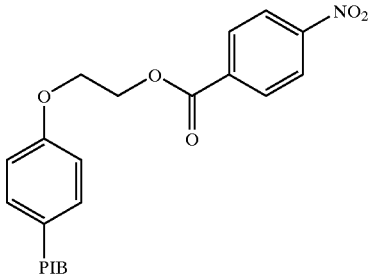

(molecular weight ~ 950)

To a flask equipped with a magnetic stirrer, thermometer, Dean-Stark trap, reflux condensor and nitrogen inlet was added 15.0 grams of the alcohol from Example 2, 2.6 grams of 4-nitrobenzoic acid and 0.24 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 15.0 grams of the desired product as a brown oil. The oil was chromatographed on silica gel, eluting with hexane/ethyl acetate (9:1) to afford 14.0 grams of the desired ester as a yellow oil. $^1$H NMR ($CDCl_3$) d 8.3 (AB quartet, 4H), 7.25 (d, 2H), 6.85 (d, 2H), 4.7 (t, 2H), 4.3 (t, 2H), 0.7–1.6 (m, 137H).

Example 5

Preparation of

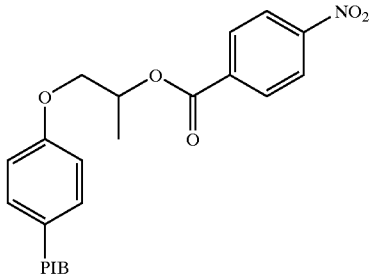

(molecular weight ~ 950)

To a flask equipped with a magnetic stirrer, thermometer, Dean-Stark trap, reflux condensor and nitrogen inlet was added 15.0 grams of the alcohol from Example 3, 2.7 grams of 4-nitrobenzoic acid and 0.23 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 16.0 grams of the desired product as a brown oil. The oil was chromatographed on silica gel, eluting with hexane/ethyl acetate (8:2) to afford 15.2 grams of the desired ester as a brown oil. $^1$H NMR ($CDCl_3$) d 8.2 (AB quartet, 4H), 7.25 (d, 2H), 6.85 (d, 2H), 5.55 (hx, 1H), 4.1 (t, 2H), 0.6–1.8 (m, 140H).

Example 6

Preparation of

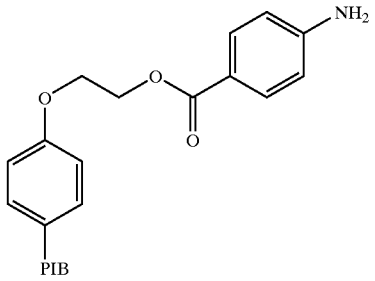

(molecular weight ~ 950)

A solution of 9.4 grams of the product from Example 4 in 100 milliliters of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 7.7 grams of the desired product as a yellow oil. $^1$H NMR ($CDCl_3$) d 7.85 (d, 2H), 7.3 (d, 2H), 6.85 (d, 2H), 6.6 (d, 2H), 4.6 (t, 2H), 4.25 (t, 2H), 4.05 (bs, 2H), 0.7–1.6 (m, 137H).

Example 7

Preparation of

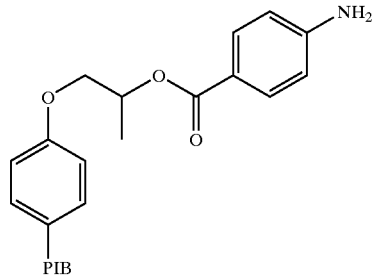

(molecular weight ~ 950)

A solution of 15.2 grams of the product from Example 5 in 200 milliliters of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 15.0 grams of the desired product as a brown oil. $^1$H NMR ($CDCl_3/D_2O$) d 7.85 (d, 2H), 7.25 (d, 2H), 6.85 (d, 2H), 6.6 (d, 2H), 5.4 (hx, 1H), 3.8–4.2 (m, 4H), 0.6–1.8 (m, 140H).

Example 8

Preparation of Dodecylphenoxy Poly(oxybutylene) poly(oxypropylene) Amine

A dodecylphenoxypoly(oxybutylene)poly(oxypropylene) amine was prepared by the reductive amination with ammonia of the random copolymer poly(oxyalkylene) alcohol, dodecylphenoxy poly(oxybutylene)poly(oxypropylene) alcohol, wherein the alcohol has an average molecular weight of about 1598. The poly(oxyalkylene) alcohol was prepared from dodecylphenol using a 75/25 weight/weight ratio of butylene oxide and propylene oxide, in accordance with the procedures described in U.S. Pat. Nos. 4,191,537; 2,782,240 and 2,841,479, as well as in Kirk-Othmer, "Encyclopedia of Chemical Technology", 4th edition, Volume 19, 1996, page 722. The reductive amination of the poly (oxyalkylene) alcohol was carried out using conventional techniques as described in U.S. Pat. Nos. 5,112,364; 4,609, 377 and 3,440,029.

Example 9

Preparation of Dodecylphenoxy Poly(oxybutylene) Amine

A dodecylphenoxy poly(oxybutylene) amine was prepared by the reductive amination with ammonia of a dodecylphenoxy poly(oxybutylene) alcohol having an average molecular weight of about 1600. The dodecylphenoxy poly (oxybutylene) alcohol was prepared from dodecylphenol and butylene oxide, in accordance with the procedures described in U.S. Pat. Nos. 4,191,537; 2,782,240, and 2,841, 479, as well as in Kirk-Othmer, "Encyclopedia of Chemical Technology", $4^{th}$ edition, Volume 19, 1996, page 722. The reductive amination of the dodecylphenoxy poly (oxybutylene) alcohol was carried out using conventional techniques as described in U.S. Pat. Nos. 5,112,364; 4,609, 377; and 3,440,029.

Example 10

Direct Injection Spark Ignition Gasoline Engine Test

The fuel additive composition employed in the present invention was tested in a Mitsubishi vehicle equipped with a 1.8 liter four cylinder engine to evaluate intake valve, injector, and combustion chamber deposit performance. The four-cylinder 1.8 liter Mitsubishi engine is a direct injection spark ignition gasoline engine and is of a four valve per cylinder configuration. The engine was prepared for each test in accordance with accepted engine testing practices. The test procedure used consisted of a 5,000 mile deposit build-up phase followed by a tankful deposit clean up phase, all performed on a mileage accumulator lane. The details of the test cycle for the Mitsubishi direct injection engine are set forth in Table I.

TABLE I

| Vehicle Speed (MPH) | Total Time Duration (min:sec) |
|---|---|
| 20 | 1:59 |
| 30 | 16.18 |
| 40 | 15:13 |
| 60 | 4:07 |
| 70 | 4:13 |

All of the test runs were made with the same base gasoline, which was representative of commercial unleaded gasoline fuel.

The test results from the Mitsubishi vehicle are set forth in Tables II and III.

TABLE II

| Fuel | AVG Intake Valve Deposit weight (mg) | AVG Piston Top Thickness mm | AVG Cylinder Head Thickness mm | AVG Piston Bowl Thickness mm | AVG % Injector restriction | Deposit Clean Up Data: AVG % Intake Valve Clean Up | AVG % Piston Top Clean Up | AVG % Piston Bowl Clean Up | AVG % Cylinder Head Clean Up | AVG % Injector Clean Up |
|---|---|---|---|---|---|---|---|---|---|---|
| Base (1) | 214 | 0.190 | 0.205 | 0.310 | 5.11% | | | | | |
| Additive (2) | 206.1 | 0.109 | 0.240 | 0.084 | 2.55% | 3.69% | 42.63% | 72.90% | −17.00% | 50.10% |
| Base (3) | 277 | 0.226 | 0.235 | 0.349 | 4.27% | | | | | |
| Additive (4) | 261.3 | 0.141 | 0.234 | 0.129 | 1.67% | 5.67% | 37.61% | 63.03% | 0.42% | 60.89% |
| Average Values | | | | | | 4.68% | 40.12% | 67.97% | −8.30% | 55.50% |

(1) Neat base fuel used for deposit formation phase.
(2) Additive used for one tankful deposit removal phase: mixture of 220 ppma (parts per million actives) of 4-polyisobutylphenoxyethyl para-aminobenzoate prepared as described in Example 6 and 2200 ppma of dodecylphenoxy poly(oxybutylene) amine prepared as described in Example 9.
(3) Same base fuel as item number (1).
(4) Same additive as item number (2).

TABLE III

| Fuel | AVG Intake Valve Deposit weight (mg) | AVG Piston Top Thickness mm | AVG Cylinder Head Thickness mm | AVG Piston Bowl Thickness mm | AVG % Injector restriction | Deposit Clean Up Data: AVG % Intake Valve Clean Up | AVG % Piston Top Clean Up | AVG % Piston Bowl Clean Up | AVG % Cylinder Head Clean Up | AVG % Injector Clean Up |
|---|---|---|---|---|---|---|---|---|---|---|
| Base (1) | 266.5 | 0.213 | 0.245 | 0.326 | 3.65% | | | | | |
| Additive (2) | 304.2 | 0.141 | 0.241 | 0.101 | 1.67% | −14.14% | 33.80% | 69.01% | 1.63% | 54.25% |
| Base (3) | 258.5 | 0.243 | 0.295 | 0.374 | 4.49% | | | | | |
| Additive (4) | 250 | 0.165 | 0.282 | 0.166 | 2.36% | 3.28% | 32.09% | 55.61% | 4.40% | 47.44% |
| Average Values | | | | | | −5.43% | 32.95% | 62.31% | 3.02% | 50.85% |

(1) Neat base fuel used for deposit formation phase.
(2) Additive used for one tankful deposit removal phase: mixture of 605 ppma (parts per million actives) of 4-polyisobutylphenoxyethyl para-aminobenzoate prepared as described in Example 6 and 1815 ppma of dodecylphenoxy poly(oxybutylene) amine prepared as described in Example 9.
(3) Same base fuel as item number (1).
(4) Same additive as item number (2).

The base fuel employed in the above engine test contained no fuel detergent. The test compounds were admixed with the base fuel at the indicated concentrations.

The data in Tables II and III illustrates the significant reduction in engine deposits, particularly injector, piston bowl and piston top deposits, provided by the presently employed additive composition, compared to the base fuel.

What is claimed is:

1. A method for reducing piston top and piston bowl deposits in a direct injection spark ignition gasoline engine which comprises operating the engine in at least stratified air/fuel charging with a fuel composition having a major amount of hydrocarbons boiling in the gasoline range and an effective deposit-controlling amount of a fuel additive composition comprising:

(a) an aromatic ester compound of the formula:

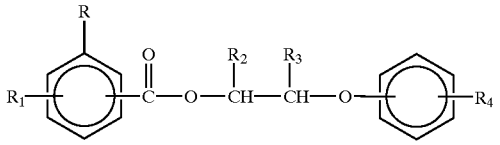

or a fuel soluble salt thereof, wherein R is hydroxy, nitro or —$(CH_2)_x$—$NR_5R_6$, wherein $R_5$ and $R_6$ are independently hydrogen or lower alkyl having 1 to 6 carbon atoms and x is 0 or 1;

$R_1$ is hydrogen, hydroxy, nitro or —$NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) a poly(oxyalkylene) amine having at least one basic nitrogen atom and a sufficient number of oxyalkylene units to render the poly(oxyalkylene) amine soluble in hydrocarbons boiling in the gasoline range.

2. The method according to claim 1, wherein R is nitro, amino or —$CH_2NH_2$.

3. The method according to claim 2, wherein R is amino, or —$CH_2NH_2$.

4. The method according to claim 3, wherein R is amino.

5. The method according to claim 1, wherein $R_1$ is hydrogen, hydroxy, nitro or amino.

6. The method according to claim 5, wherein $R_1$ is hydrogen or hydroxy.

7. The method according to claim 6, wherein $R_1$ is hydrogen.

8. The method according to claim 1, wherein one of $R_2$ and $R_3$ is hydrogen or lower alkyl of 1 to 4 carbon atoms, and the other is hydrogen.

9. The method according to claim 8, wherein one of $R_2$ and $R_3$ is hydrogen, methyl or ethyl, and the other is hydrogen.

10. The method according to claim 9, wherein $R_2$ is hydrogen, methyl or ethyl, and $R_3$ is hydrogen.

11. The method according to claim 1, wherein $R_4$ is a polyalkyl group having an average molecular weight in the range of about 500 to 3,000.

12. The method according to claim 11, wherein $R_4$ is a polyalkyl group having an average molecular weight in the range of about 700 to 3,000.

13. The method according to claim 12, wherein $R_4$ is a polyalkyl group having an average molecular weight in the range of about 900 to 2,500.

14. The method according to claim 1, wherein $R_4$ is a polyalkyl group derived from polypropylene, polybutene, or a polyalphaolefin oligomer of 1-octene or 1-decene.

15. The method according to claim 14, wherein $R_4$ is a polyalkyl group derived from polyisobutene.

16. The method according to claim 15, wherein the polyisobutene contains at least about 20% of a methylvinylidene isomer.

17. The method according to claim 1, wherein R is amino, $R_1$, $R_2$ and $R_3$ are hydrogen and $R_4$ is a polyalkyl group derived from polyisobutene.

18. The method according to claim 1, wherein said poly(oxyalkylene) amine has a molecular weight in the range of about 500 to about 10,000.

19. The method according to claim 1, wherein said poly(oxyalkylene) amine contains at least about 5 oxyalkylene units.

20. The method according to claim 1, wherein said poly(oxyalkylene) amine is a hydrocarbyl poly (oxyalkylene) polyamine.

21. The method according to claim 1, wherein said poly(oxyalkylene) amine is a hydrocarbyl poly (oxyalkylene) aminocarbamate.

22. The method according to claim 21, wherein the hydrocarbyl group of said hydrocarbyl poly(oxyalkylene) aminocarbamate contains from 1 to about 30 carbon atoms.

23. The method according to claim 22, wherein said hydrocarbyl group of said hydrocarbyl poly(oxyalkylene) aminocarbamate is an alkylphenyl group.

24. The method according to claim 23, wherein the alkyl moiety of said alkylphenyl group is tetrapropenyl.

25. The method according to claim 21, wherein the amine moiety of said hydrocarbyl poly(oxyalkylene) aminocarbamate is derived from a polyamine having from 2 to 12 amine nitrogen atoms and from 2 to 40 carbon atoms.

26. The method according to claim 25, wherein said polyamine is a polyalkylene polyamine having 2 to 12 amine nitrogen atoms and 2 to 24 carbon atoms.

27. The method according to claim 26, wherein said polyalkylene polyamine is selected from the group consisting of ethylenediamine, propylenediamine, diethylenetriamine and dipropylenetriamine.

28. The method according to claim 21, wherein the poly(oxyalkylene) moiety of said hydrocarbyl poly (oxyalkylene) aminocarbamate is derived from $C_2$ to $C_5$ oxyalkylene units.

29. The method according to claim 21, wherein said hydrocarbyl poly(oxyalkylene) aminocarbamate is an alkylphenyl poly(oxybutylene) aminocarbamate, wherein the amine moiety is derived from ethylenediamine or diethylenetriamine.

30. The method according to claim 1, wherein said poly(oxyalkylene) amine is a hydrocarbyl poly (oxyalkylene) monoamine.

31. The method according to claim 30, wherein said hydrocarbyl poly(oxyalkylene) monoamine is an alkylphenyl poly(oxyalkylene) monoamine, wherein the poly (oxyalkylene) moiety contains oxypropylene units or oxybutylene units or mixtures thereof.

32. The method according to claim 31, wherein the alkylphenyl group is tetrapropenylphenyl.

33. The method according to claim 1, wherein the poly (oxyalkylene) amine is a hydrocarbyl-substituted poly (oxyalkylene amine) compound of the formula:

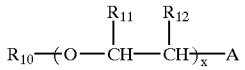

or a fuel-soluble salt thereof;

wherein $R_{10}$ is a hydrocarbyl group having from about 1 to about 30 carbon atoms;

$R_{11}$ and $R_{12}$ are each independently hydrogen or lower alkyl having from about 1 to about 6 carbon atoms and each $R_{11}$ and $R_{12}$ is independently selected in each —O—$CHR_{11}$—$CHR_{12}$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

34. The method according to claim 33, wherein $R_{10}$ is an alkyl or alkylphenyl group.

35. The method according to claim 34, wherein $R_{10}$ is an alkylphenyl group.

36. The method according to claim 33, wherein one of $R_{11}$ and $R_{12}$ is lower alkyl of 1 to 4 carbon atoms, and the other is hydrogen.

37. The method according to claim 36, wherein one of $R_{11}$ and $R_{12}$ is methyl or ethyl, and the other is hydrogen.

38. The method according to claim 33, wherein x is an integer of from about 5 to about 50.

39. The method according to claim 38, wherein x is an integer of from about 8 to about 30.

40. The method according to claim 39, wherein x is an integer of from about 10 to about 25.

41. The method according to claim 33, wherein A is amino, N-alkylamino or a polyamine moiety.

42. The method according to claim 41, wherein A is amino or N-alkyl amino having from about 1 to about 4 carbon atoms.

43. The method according to claim 42, wherein A is amino.

44. The method according to claim 41, wherein A is a polyamine moiety having from about 2 to about 12 amine nitrogen atoms and from about 2 to about 40 carbon atoms.

45. The method according to claim 44, wherein A is a polyamine moiety derived from a polyalkylene polyamine containing from about 2 to about 12 amine nitrogen atoms and from about 2 to about 24 carbon atoms.

46. The method according to claim 45, wherein the polyalkylene polyamine has the formula:

$$H_2N—(R_{13}—NH)_z—H$$

wherein $R_{13}$ is an alkylene group having from about 2 to about 6 carbon atoms and z is an integer from about 1 to about 4.

47. The method according to claim 46, wherein $R_{13}$ is an alkylene group having from about 2 to about 4 carbon atoms.

48. The method according to claim 46, wherein the polyalkylene polyamine is ethylene diamine or diethylene triamine.

49. The method according to claim 48, wherein the polyalkylene polyamine is ethylene diamine.

50. The method according to claim 1, wherein the fuel composition contains from about 25 to about 5,000 parts per million by weight of said aromatic ester compound and about 25 to about 10,000 parts per million by weight of said poly(oxyalkylene) amine.

51. The method according to claim 50, wherein the fuel composition contains from about 50 to about 2,000 parts per million by weight of said aromatic ester compound and about 50 to about 5,000 parts per million by weight of said poly(oxyalkylene) amine.

52. The method according to claim 1, wherein the fuel composition further contains from about 25 to about 15,000 parts per million by weight of a fuel-soluble, nonvolatile carrier fluid.

53. A method for controlling engine deposits in a direct injection spark ignition gasoline engine which comprises contacting the engine intake system with a fuel additive concentrate comprising an inert stable oleophilic organic solvent boiling in the range of from about 150° F. to about 700° F. and from about 5 to about 90 weight percent of fuel additive composition comprising:

(a) an aromatic ester compound of the formula:

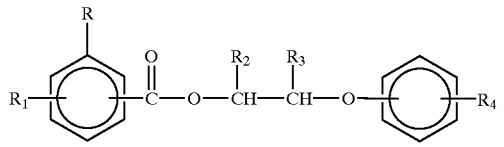

or a fuel soluble salt thereof, wherein R is hydroxy, nitro or $—(CH_2)_x—NR_5R_6$, wherein $R_5$ and $R_6$ are independently hydrogen or lower alkyl having 1 to 6 carbon atoms and x is 0 or 1;

$R_1$ is hydrogen, hydroxy, nitro or $—NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) a poly(oxyalkylene) amine having at least one basic nitrogen atom and a sufficient number of oxyalkylene units to render the poly(oxyalkylene) amine soluble in hydrocarbons boiling in the gasoline range.

54. The method according to claim 53, wherein R is nitro, amino or $—CH_2NH_2$.

55. The method according to claim 54, wherein R is amino, or $—CH_2NH_2$.

56. The method according to claim 55, wherein R is amino.

57. The method according to claim 53, wherein $R_1$ is hydrogen, hydroxy, nitro or amino.

58. The method according to claim 57, wherein $R_1$ is hydrogen or hydroxy.

59. The method according to claim 58, wherein $R_1$ is hydrogen.

60. The method according to claim 53, wherein one of $R_2$ and $R_3$ is hydrogen or lower alkyl of 1 to 4 carbon atoms, and the other is hydrogen.

61. The method according to claim 60, wherein one of $R_2$ and $R_3$ is hydrogen, methyl or ethyl, and the other is hydrogen.

62. The method according to claim 61, wherein $R_2$ is hydrogen, methyl or ethyl, and $R_3$ is hydrogen.

63. The method according to claim 53, wherein $R_4$ is a polyalkyl group having an average molecular weight in the range of about 500 to 3,000.

64. The method according to claim 53, wherein $R_4$ is a polyalkyl group having an average molecular weight in the range of about 700 to 3,000.

65. The method according to claim 64, wherein $R_4$ is a polyalkyl group having an average molecular weight in the range of about 900 to 2,500.

66. The method according to claim 53, wherein $R_4$ is a polyalkyl group derived from polypropylene, polybutene, or a polyalphaolefin oligomer of 1-octene or 1-decene.

67. The method according to claim 66, wherein $R_4$ is a polyalkyl group derived from polyisobutene.

68. The method according to claim 67, wherein the polyisobutene contains at least about 20% of a methylvinylidene isomer.

69. The method according to claim 53, wherein R is amino, $R_1$, $R_2$ and $R_3$ are hydrogen and $R_4$ is a polyalkyl group derived from polyisobutene.

70. The method according to claim 53, wherein said poly(oxyalkylene) amine is a hydrocarbyl poly (oxyalkylene) aminocarbamate.

71. The method according to claim 70, wherein the hydrocarbyl group of said hydrocarbyl poly(oxyalkylene) aminocarbamate contains from 1 to about 30 carbon atoms; and wherein the amine moiety of said hydrocarbyl poly (oxyalkylene) aminocarbamate is derived from a polyamine having from 2 to 12 amine nitrogen atoms and from 2 to 40 carbon atoms.

72. The method according to claim 71, wherein said hydrocarbyl group of said hydrocarbyl poly(oxyalkylene) aminocarbamate is an alkylphenyl group; and wherein said polyalkylene polyamine is selected from the group consisting of ethylenediamine, propylenediamine, diethylenetriamine and dipropylenetriamine.

73. The method according to claim 72, wherein the alkyl moiety of said alkylphenyl group is tetrapropenyl.

74. The method according to claim 70, wherein said hydrocarbyl poly(oxyalkylene) aminocarbamate is an alkylphenyl poly(oxybutylene) aminocarbamate, wherein the amine moiety is derived from ethylenediamine or diethylenetriamine.

75. The method according to claim 53, wherein said poly(oxyalkylene) amine is a hydrocarbyl poly (oxyalkylene) monoamine.

76. The method according to claim 75, wherein said hydrocarbyl poly(oxyalkylene) monoamine is an alkylphenyl poly(oxyalkylene) monoamine, wherein the poly (oxyalkylene) moiety contains oxypropylene units or oxybutylene units or mixtures thereof.

77. The method according to claim 76, wherein the alkylphenyl group is tetrapropenylphenyl.

78. The method according to claim 53, wherein the poly(oxyalkylene) amine is a hydrocarbyl-substituted poly (oxyalkylene) amine compound of the formula:

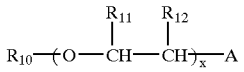

or a fuel soluble salt thereof;

wherein $R_{10}$ is hydrocarbyl group having from 1 to about 30 carbon atoms;

$R_{11}$ and $R_{12}$ are independently hydrogen or lower alkyl having from about 1 to about 6 carbon atoms and each $R_{11}$ and $R_{12}$ is independently selected in each —O—$HR_{11}$—$CHR_{12}$;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

79. The method according to claim 78, wherein $R_{10}$ is an alkyl or alkylphenyl group.

80. The method according to claim 79, wherein $R_{10}$ is an alkylphenyl group.

81. The method according to claim 78, wherein one of $R_{11}$ and $R_{12}$ is lower alkyl of 1 to 4 carbon atoms, and the other is hydrogen.

82. The method according to claim 81, wherein one of $R_{11}$ and $R_{12}$ is methyl or ethyl, and the other is hydrogen.

83. The method according to claim 78, wherein x is an integer of from about 5 to about 50.

84. The method according to claim 83, wherein x is an integer of from about 8 to about 30.

85. The method according to claim 84, wherein x is an integer of from about 10 to about 25.

86. The method according to claim 78, wherein A is amino, N-alkylamino or a polyamine moiety.

87. The method according to claim 86, wherein A is amino or N-alkyl amino having from about 1 to about 4 carbon atoms.

88. The method according to claim 87, wherein A is amino.

89. The method according to claim 86, wherein A is a polyamine moiety having from about 2 to about 12 amine nitrogen atoms and from about 2 to about 40 carbon atoms.

90. The method according to claim 89, wherein A is a polyamine moiety derived from a polyalkylene polyamine containing from about 2 to about 12 amine nitrogen atoms and from about 2 to about 24 carbon atoms.

91. The method according to claim 90, wherein the polyalkylene polyamine has the formula:

$$H_2N—(R_{13}—NH)_z—H$$

wherein $R_{13}$ is an alkylene group having from about 2 to about 6 carbon atoms and z is an integer from about 1 to about 4.

92. The method according to claim 91, wherein $R_{13}$ is an alkylene group having from about 2 to about 4 carbon atoms.

93. The method according to claim 91, wherein the polyalkylene polyamine is ethylene diamine or diethylene triamine.

94. The method according to claim 93, wherein the polyalkylene polyamine is ethylene diamine.

95. The method according to claim 53, wherein the fuel additive concentrate contains from about 10 to about 70 weight percent of said fuel additive composition.

96. The method according to claim 95, wherein the fuel additive concentrate contains from about 10 to about 50 weight percent of said fuel additive composition.

97. The method according to claim 96, wherein the fuel additive concentrate contains from about 20 to about 40 weight percent of said fuel additive composition.

98. The method according to claim 53, wherein the fuel additive concentrate further contains from about 10 to about 80 weight percent of a fuel-soluble, nonvolatile carrier fluid.

99. The method according to claim 1 wherein the deposit-controlling amount of a fuel additive composition further provides fuel injector deposit control.

* * * * *